US009456678B1

(12) United States Patent
Harooni

(10) Patent No.: US 9,456,678 B1
(45) Date of Patent: Oct. 4, 2016

(54) ROLLER APPLICATOR WITH LED

(71) Applicant: Hooshmand Harooni, Los Angeles, CA (US)

(72) Inventor: Hooshmand Harooni, Los Angeles, CA (US)

( * ) Notice: Subject to any disclaimer, the term of this patent is extended or adjusted under 35 U.S.C. 154(b) by 0 days.

(21) Appl. No.: 15/046,162

(22) Filed: Feb. 17, 2016

(51) Int. Cl.

| | |
|---|---|
| ***F21V 33/00*** | (2006.01) |
| ***A45D 40/18*** | (2006.01) |
| ***F21V 23/00*** | (2015.01) |
| ***F21V 23/02*** | (2006.01) |
| ***F21V 23/04*** | (2006.01) |
| ***A45D 34/04*** | (2006.01) |
| ***A45D 40/26*** | (2006.01) |
| *F21Y 101/02* | (2006.01) |

(52) U.S. Cl.
CPC ..... *A45D 40/18* (2013.01); *A45D 34/041* (2013.01); *A45D 40/261* (2013.01); *F21V 23/003* (2013.01); *F21V 23/02* (2013.01); *F21V 23/04* (2013.01); *F21V 33/0004* (2013.01); *F21Y 2101/02* (2013.01)

(58) Field of Classification Search
CPC ... A45D 40/18; A45D 34/041; A45D 40/261
See application file for complete search history.

(56) References Cited

U.S. PATENT DOCUMENTS

| | | | | |
|---|---|---|---|---|
| 8,599,306 | B2 | 12/2013 | Rolston | |
| 9,101,193 | B1 | 8/2015 | Liu | |
| 2006/0146557 | A1* | 7/2006 | Levy | A45D 33/32 362/551 |
| 2008/0014011 | A1* | 1/2008 | Rossen | A45D 34/041 401/195 |
| 2009/0299236 | A1* | 12/2009 | Pryor | A61H 15/0092 601/18 |
| 2012/0109041 | A1* | 5/2012 | Munz | A45D 34/041 604/20 |
| 2012/0207532 | A1* | 8/2012 | Ho | A45D 34/041 401/209 |
| 2015/0360014 | A1* | 12/2015 | Decaux | A61M 35/003 604/20 |

OTHER PUBLICATIONS

Artistry, "Light Up Lip Gloss—Confetti (Neutral, Shimmer)", http://www.amazon.com/ARTISTRY-Light-Up-Lip-Gloss/dp/B007LU37QG, screen capture Dec. 2, 2015.
Glitterforever17, "DIY Light-Up EOS Lip Balm! DIY Flashing EOS! Make Your EOS Lip Balm Light Up!", https://www.youtube.com/watch?v=1ZoAHfmgcNE, screen capture Feb. 17, 2016.
"LED flavour lip balm", http://www.alibaba.com/product-detail/LED-flavour-lip-balm_60093904869.html?spm=a2700.7724857.29.152.Qvmi8A, screen capture Dec. 2, 2015.
"LED Sunscreen lips lip balm", http://www.alibaba.com/product-detail/LED-Sunscreen-lips-lip-balm_676133963.html?spm=a2700.7724857.29206.Qvmi8A, screen capture Dec. 2, 2015.

* cited by examiner

*Primary Examiner* — Evan Dzierzynski
(74) *Attorney, Agent, or Firm* — Fish & Tsang LLP

(57) ABSTRACT

An applicator assembly is disclosed having a rotating applicator, a controller, and an LED. A fragrance, cosmetic or other substance, preferably liquid, gelatinous, semi-fluid, or semi-solid, is applied to the user or object by pressing dragging the rolling applicator onto an application surface. As the applicator is dragged, the rolling applicator rotates and distributes the fragrance, cosmetic or other substance onto the application surface. In addition, as the rolling applicator rotates, the controller can generate signals based on movement of the rolling applicator that are used to vary an attribute of light emitting from one or more LEDs. Movement of the rotating applicator preferably causes a change in the wavelength or intensity of the one or more LEDs.

17 Claims, 4 Drawing Sheets

ROLLER APPLICATOR WITH LED

FIELD OF THE INVENTION

The field of the invention is applicators.

BACKGROUND

The description herein includes information that may be useful in understanding the present invention. It is not an admission that any of the information provided herein is prior art or relevant to the presently claimed invention, or that any publication specifically or implicitly referenced is prior art.

Applicators for cosmetics, such as ChapStick®, lip balm, or lip gloss, and applicators for fragrances are small items that are regularly carried by people. However, known applicators are generally single purpose items that lack any additional utility or interesting aspect. Some effort has been made to improve the utility of these applicators. For example, one known lip balm applicator available on the Alibaba Group's website incorporates LED lights at the base, opposite the lip balm end, for use as a flash light. However, these applicators apparently fail to help in low light situations to light the area of application.

Use of cosmetic and fragrance applicators in low light settings, such as night clubs or concerts, can be a difficult task. Efforts have been made to improve the ease of using these applicators in low light settings. As seen in U.S. Pat. No. 8,599,306 issued to Rolston, and U.S. Pat. No. 9,101,193 issued to Liu, bright LED lights have been incorporated into some applicators, which can shine light on the point of application.

All publications herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

However, the above referenced lights are harsh and brighter than necessary. They act as an eyesore and disrupt the fun and exciting atmosphere found in low light settings such as clubs and concerts.

Some other efforts have been made to improve the aesthetic appeal of cosmetic applicators and turn them into fun accessories, while still providing some ambient light when using the applicator. For example, some cases for solid form lip balms (i.e., EOS solid lip balm cases) have been altered to include flashing, multicolored LED lights that shine through the lip balm and the case. However, the LED light and color apparently cannot be controlled by the user or selectively turned on and off, and the lip balm case is not suitable for non-solid cosmetics and fragrances.

Thus, there remains a need for improved cosmetic, fragrance, and other applicators.

SUMMARY OF THE INVENTION

The inventive subject matter provides systems, apparatus, and methods for applying cosmetics or fragrances using a rolling applicator equipped with an LED that changes at least one of color and intensity as the applicator rolls.

One aspect of the inventive subject matter includes an applicator assembly for applying cosmetics or fragrances. Such applicator includes a housing, and a rounded applicator rotatably coupled to or near the end of the housing. A controller can be disposed or set in an interior wall of the housing such that the controller moves in response to a movement of the rounded applicator. A light source can be at least partially disposed within a part of the housing, and electrically coupled to the controller such that an attribute of the light emitted from the light source (e.g. wavelength, amplitude, frequency, or intensity) changes as the controller moves or is otherwise affected by the rounded applicator. It is contemplated that a flowable substance, such as perfume, lip gloss, fluid, gel, semi-fluid, semi-solid cosmetics, or any combination thereof can be inside the housing and applied via the rounded applicator.

In some aspects of the inventive subject matter, an applicator assembly includes a housing including two ends, and an optionally narrowed passage within the housing disposed between the two ends. A rotating applicator can be positioned at one end of the housing adjacent one end of the passage, and a controller can be coupled to the wall of the housing, optionally at least partially within the wall's thickness. The controller can advantageously be positioned such that part of its surface contacts part the rotating applicator surface. A light source can be included, for example embedded in the housing wall's thickness, and coupled to the controller and a power source.

Alternatively, the controller, light source, or any other component(s) can be disposed within the housing's interior space, and coupled to an inner surface of the housing's wall. In these and some other contemplated embodiments, the passage may not necessarily be narrowed, and can even be widened, to accommodate the component(s) disposed within the housing's interior space.

In some embodiments, the application surface is rounded, preferably spherical. The controller can also be rounded, and can be rotatably coupled to the housing wall. In some embodiments, the controller is at least partially embedded in the housing wall.

In one aspect of the inventive subject matter, the light source is a LED. It is contemplated that the applicator can include more than one light source (e.g., at least 2, at least 3, at least 5, or even more light sources). In some embodiments the controller changes an attribute of the light emitted from at least one of the light sources (e.g. wavelength, amplitude, frequency, or intensity). Preferably, the controller changes an attribute of the light in response to a movement of the rotating applicator.

In some embodiments, a power source is further included. The power source can be in electrical communication with the controller. The power source can further be in electrical communication with a power switch, and the power switch connected to the controller. At least a portion of the power switch can extend past an outer surface of the applicator housing.

The rotating applicator can be rotatably seated at least partially within a socket positioned at an end of the applicator assembly. The controller can be at least partially embedded in the housing wall, with a portion of the controller's surface configured to contact a surface of the rotating applicator. A movement of the rolling applicator can change an attribute of light emitted from the light source via the controller.

In some embodiments, the lights source is an LED embedded in the housing wall and positioned in a socket portion of the wall. It is contemplated that the LED can be positioned in any portion of the applicator housing, including above the controller, below the controller, near a power switch, within a housing wall's thickness, or in the interior portion of the housing. Further, multiple LEDs can be positioned in multiple points in the applicator housing, including extending towards either or both ends of the applicator housing.

In some embodiments, the applicator housing, the rotating applicator, and the controller are at least partially made of plastic, but can also be made partially or exclusively of plastic, rubber, metal, wood, ceramic, silica, or a composite material.

It is contemplated that the applicator assembly can further comprise a cap, which can be removably coupled to the applicator housing. In some embodiments, a portion of the outer housing of the applicator can be shaped to mate with part of the cap. It is contemplated that when the cap is coupled to the applicator housing, a circuit connecting the power source to the controller can be open. Removing the cap from the applicator housing can close the circuit, which can at least one of activate the light source, and permit the light source to be controlled by the controller.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

Unless the context dictates the contrary, all ranges set forth herein should be interpreted as being inclusive of their endpoints, and open-ended ranges should be interpreted to include commercially practical values. Similarly, all lists of values should be considered as inclusive of intermediate values unless the context indicates the contrary.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

Various objects, features, aspects and advantages of the inventive subject matter will become more apparent from the following detailed description of preferred embodiments, along with the accompanying drawing figures in which like numerals represent like components.

DETAILED DESCRIPTION

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

The inventive subject matter provides apparatus, systems, and methods for applying cosmetics or fragrances using a rolling applicator equipped with an LED that changes color and intensity as the applicator moves (e.g., rolls).

Figure 1:
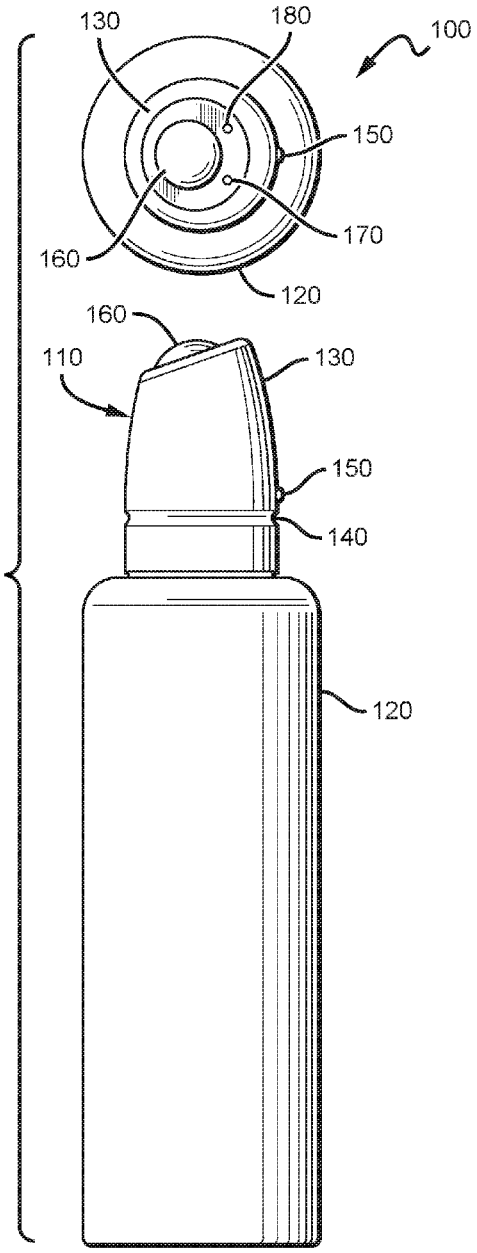
FIG. 1 is a side profile and a top down view of an applicator tip attached to a reservoir bottle.

FIG. 1 depicts applicator assembly 100 comprising applicator tip 110 and reservoir bottle 120. In some embodiments, reservoir bottle 120 can be filled with a fragrance or cosmetic substance, such as a liquid, gel, cream, oil, semi-solid, or solid. It should be appreciated that reservoir tube 220 can be made out of many materials, including glass, plastic, metal, rubber, or any other commercially suitable material. It should also be appreciated that when reservoir tube 220 is made of pliable material, such as plastic or rubber, the bottle can be squeezed during application of the cosmetic or fragrance. This allows the user to apply force in order to emit the applied substance from the applicator, and thus can permit the application of substances having a viscosity greater than, for example, 2 pascal-second (Pa·S) at 20° C.

Applicator tip 110 is depicted as coupled to reservoir bottle 120, but it should be appreciated that tip 110 and bottle 120 can be a single piece (e.g. die cast, injection molded), can be removably attached (e.g. via latch, via male and female threaded fastening, via mated groves, via lock), or can be permanently coupled (e.g. via adhesive, via fused surface). It should also be appreciated that applicator tip 110 and reservoir bottle 120 could be indirectly coupled to one another.

Applicator tip 110 comprises applicator housing 130. The surface of applicator housing 130 includes notch 140 in the embodiment shown. Notch 140 is sized and dimensioned such that it can mate with a portion of a cap, such as protrusion 392 of cap 390. Applicator tip 110 further comprises power switch 150. As depicted, power switch 150 protrudes through a portion of applicator housing 130, but it should be appreciated that switch 150 could be positioned in a recession of housing 130 or embedded within the wall of housing 130.

Applicator tip 110 further comprises rolling applicator 160. As depicted, rolling applicator 160 is spherical in shape, but it should be appreciated that rolling applicator 160 can be a curved surface, a cylinder, an ovoid, or any other rounded object capable of rolling. Rolling applicator 160 is sized and dimensioned to sit within an open end of applicator tip 110.

Applicator tip 110 further comprises LEDs 170 and 180. As depicted, LEDs 170 and 180 are positioned at a rim portion of applicator tip 110 near rolling applicator 160. It should be appreciated that LEDs 170 and 180 can be positioned at any location of applicator assembly, including within reservoir bottle 120 or within the wall of applicator tip 110. As depicted, LEDs 170 and 180 are both light emitting diodes, but it should be appreciated that LEDs 170 and 180 can be any commercially suitable light source(s), including electroluminescent panels, LEDs, and incandescent bulbs.

Figure 2:
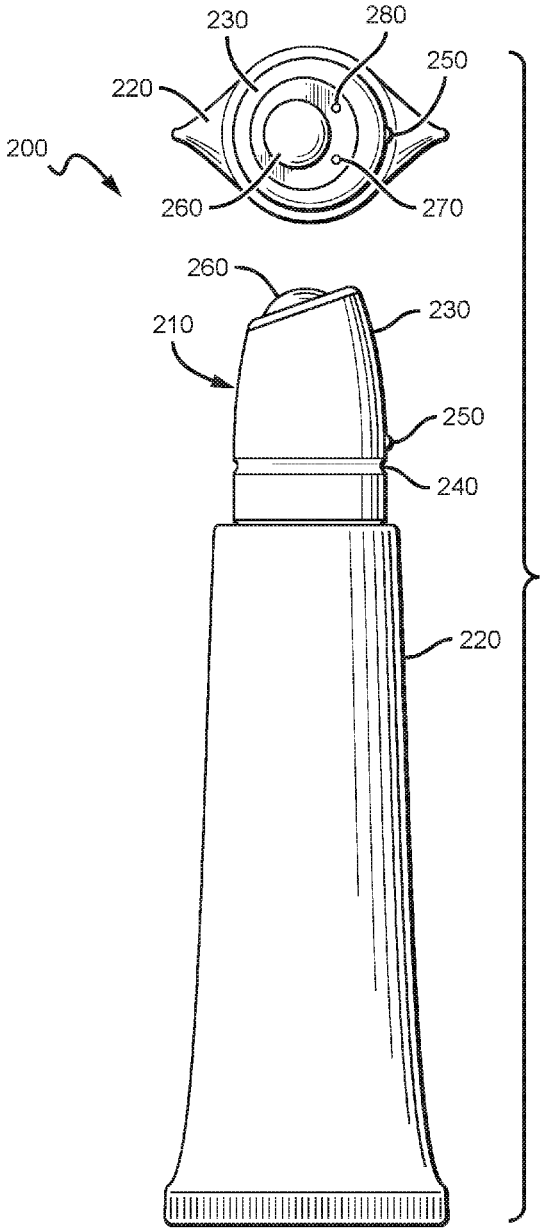
FIG. 2 is a side profile and a top down view of an applicator tip attached to a reservoir tube.

FIG. 2 depicts applicator assembly 200 comprising applicator tip 210 and reservoir tube 220. All elements having similar numbering as FIG. 1 (i.e., the same last two numbers) have the same features as described in FIG. 1.

Figure 3A:
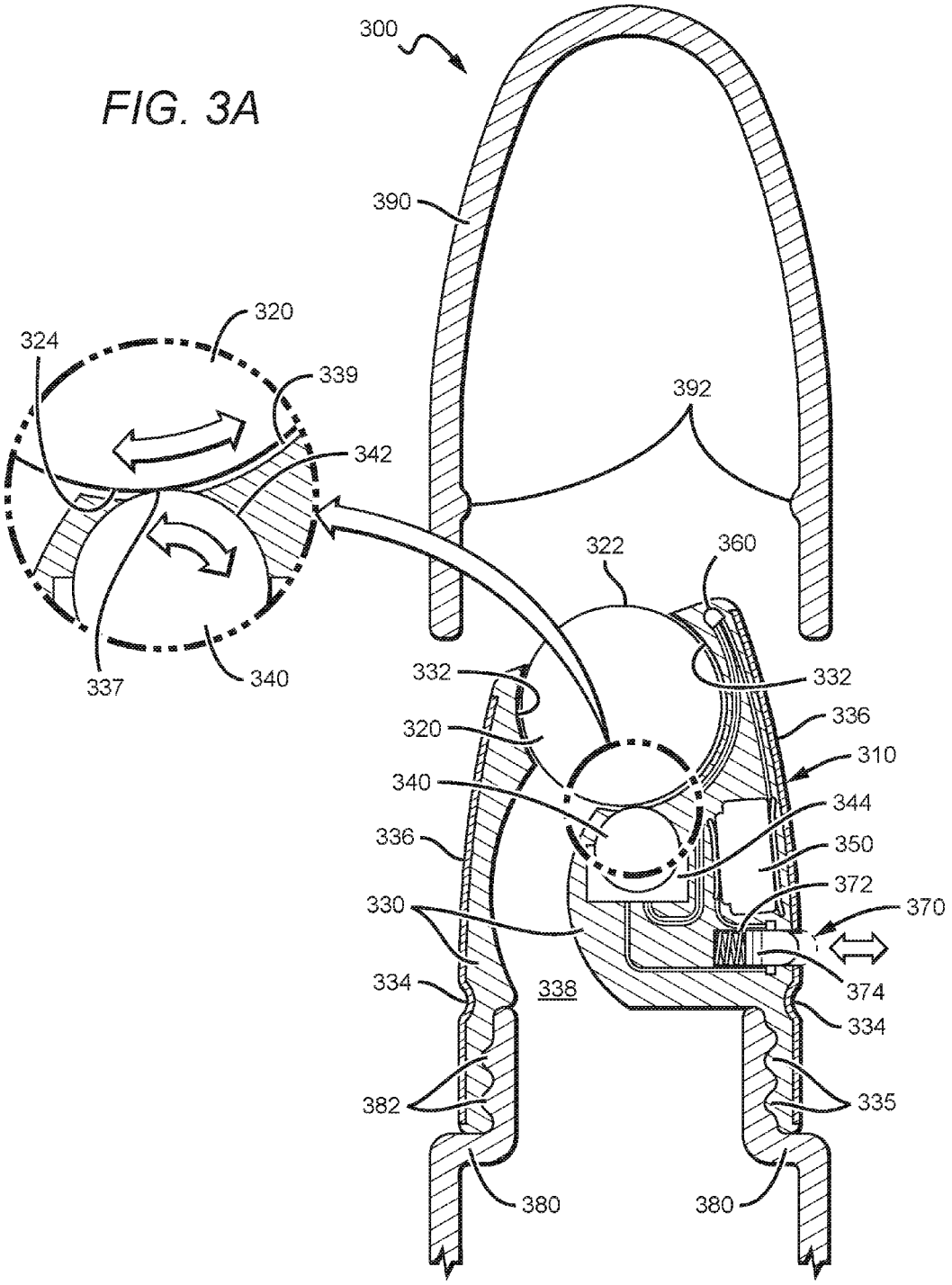
FIGS. 3A-3C are vertical cross section views of an applicator cap and an applicator tip attached to a reservoir, with the light source disposed at different positions within the applicator assembly.
Figure 3C:
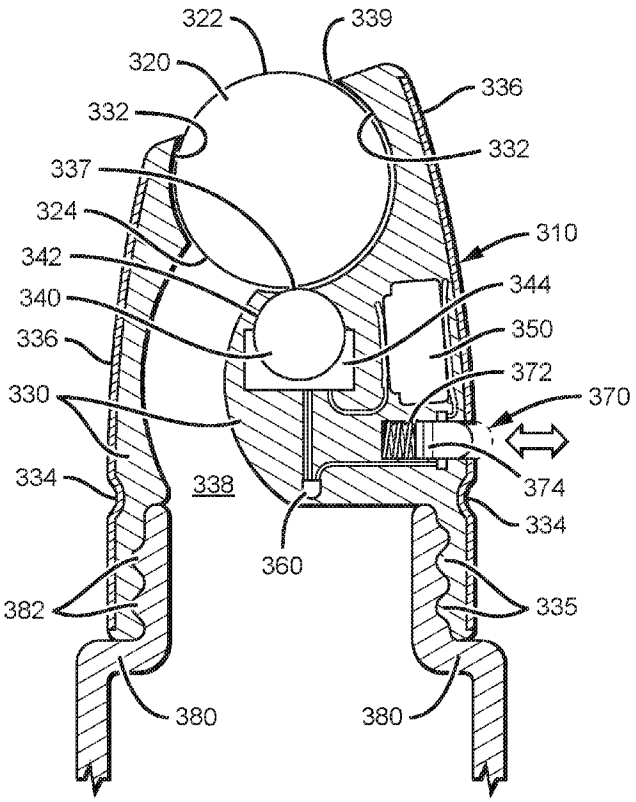
Figure 3B:
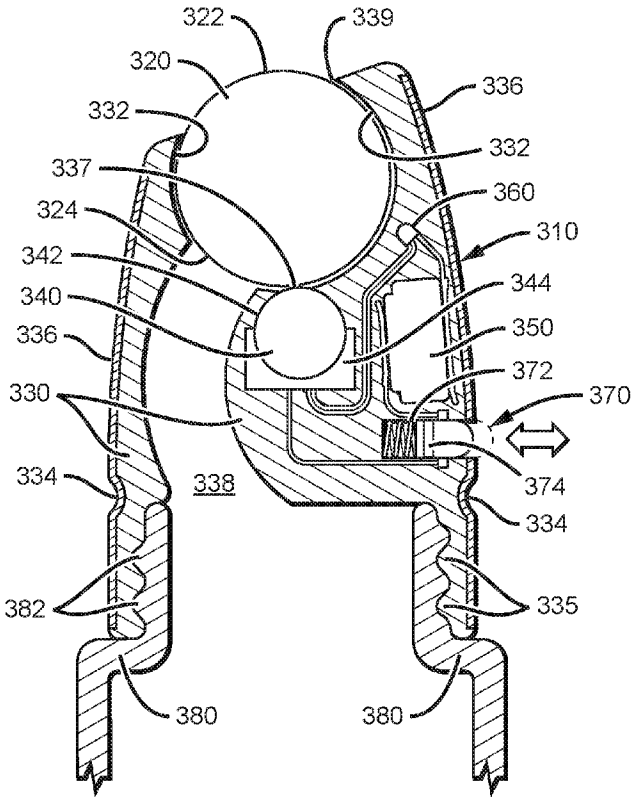

FIGS. 3A-C depict a vertical cross section of applicator assembly 300 with different LED positionings. Applicator assembly 300 comprises applicator tip 310, reservoir 380, and cap 390. As depicted, applicator tip 310 is removably coupled to reservoir 380 via mated reservoir groves 382 and housing groves 335. It should be appreciated that tip 110 and bottle 120 can be a single piece (e.g. die cast), can be removably attached (e.g. via latch, via mated groves, via lock), or can be permanently coupled (e.g. via adhesive, via fused surface).

Applicator tip 310 comprises rolling applicator 320, housing wall 330, controller 340, power source 350, LED 360, and power switch 370. Housing wall 330 comprises the body of applicator tip 310, and includes socket portion 332, notch 334, housing groves 335, housing surface 336, interior narrowed channel 338 (narrowed relative to at least one of the reservoir 380 and the socket portion 332), and effluent channel 339. Interior channel 338 can be sized and dimension such that it is wider than effluent channel 339.

Rolling applicator 320 is depicted spherical in shape, but it should be appreciated that applicator 160 can be a curved surface, a cylinder, an ovoid, or any other rounded object capable of rolling. Rolling applicator comprises application surface 322 and applicator contact surface 324. Rolling applicator 320 is rotatably seated at an open end of applicator tip 310 within a socket of housing wall 330 formed by socket portion 332.

Socket portion 332 and rotating applicator 320 are sized and dimensioned such that a portion of the surface of applicator 320, identified as application surface 322 in FIGS. 3A-C, extends beyond housing wall 330. Application surface 322 is the portion of the surface of applicator 320 that makes contact with whatever object the user applies a the applicator to. As the user presses or drags applicator assembly 300 across the applied object, applicator 320 rotates and, a new portion of surface of applicator 320 is in contact with the object and represents application surface 322. Further, socket portion 332 and rotating applicator 320 are sized and dimensioned such that applicator 320 can rotate within socket 332, and an open space identified as effluent channel 339 is formed between applicator 320 and socket 332. Effluent channel 339 is wide enough to permit the passage of cosmetic and fragrance substances through channel 339, for example, between 10 μm and 1 mm wide, inclusive, between 0.5 mm and 1.5 mm wide, inclusive, between 5 μm and 3 mm wide, inclusive, between 1 μm and 5 mm wide, inclusive, or even greater than 5 mm wide.

Controller 340 comprises controller contact surface 342 and controller circuit 344. Controller contact surface 342 is the portion of the surface of controller 340 that is in contact with applicator contact surface 324. As applicator 320 rotates, controller 340 rotates and a new portion of the surface of controller 340 is in contact with applicator 320, representing controller contact surface 342. As depicted, controller 340 is partially embedded in housing wall 330, but it should be appreciated that controller 340 could be coupled to the surface of housing wall 330 or could be suspended in interior channel 338 by additional supports. Controller 340 is sized, dimensioned, and positioned such that at least a portion of controller 340, depicted as controller contact surface 342, is in, or configured to be in, communication with applicator contact surface 324. As depicted, surfaces 324 and 342 are in physical contact at point 337, but it should be appreciated that communication between surfaces 324 and 342 can take place by means of electromagnetic forces or thermal forces as well.

Controller 340 is coupled to housing wall 330 such that controller 340 rotates in response to a force applied by applicator contact surface 324 on to controller contact surface 324 at point 337. All movement of controller 340 can be communicated to controller circuit 344 via, for example, electric impulses, variance of electromagnetic field, or digital electric signals. As a further example, controller 340 can be embedded with a plurality of magnets having variable properties. The rotation of controller 340, the movement of the plurality of magnets, as well as the change in electromagnetic field properties, can be detected by controller circuit 344. The variable signals communicated to controller circuit 344 are ultimately used to vary one or more light attributes of LED 360, preferably at least one of the intensity and the wavelength. While controller 340 is depicted as spherical, it should be appreciated that controller 340 can be a curved surface, a cylinder, an ovoid, or any other rounded object capable of rolling.

As illustrated, power source 350 is embedded in housing wall 330 and electrically coupled to power switch 370 and LED 360. While power source 350 is preferably a non-rechargeable alkaline battery, any other commercially suitable battery technologies (e.g lithium-ion battery, rechargeable batteries) and power sources (e.g. piezoelectric generator, photovoltaic cell, electromagnetic induction) are contemplated.

LED 360 is embedded in housing wall 330 as depicted in FIGS. 3A-C, and is electrically coupled to power source 350 and controller circuit 344. While LED 360 is a light emitting diode, it should be appreciated that LED 360 can be any appropriate light source, including electroluminescent panels, LEDs, and incandescent bulbs. Further, it should be appreciated that more than one LED or more than one type of light source are included in some embodiments. For example, one light source could be an LED controlled by controller circuit 344, and a second light source could be an electroluminescent panel controlled only by power switch 370.

Power switch 370 comprises spring 372 and circuit gate 374, and is electrically coupled to controller circuit 344 and power source 350. As depicted in FIGS. 3A-C, power switch 370 can move between a depressed position and an extended position. In the depressed position, depicted by solid lines in FIGS. 3A-C, a force (preferably protrusion 392 of cap 390) pushes power switch 370 toward the center of applicator tip 310. This force can puts spring 372 under tension and open circuit gate 374, which could prevent the electrical coupling between power source 350, controller 340, and LED 360 from being completed. In the extended position, depicted by dashed lines in FIGS. 3A-C, no force pushes power switch 370 and the tension of spring 372 presses switch 370 outward from applicator tip 310. This can close circuit gate 374 and complete the electrical coupling between power source 350, controller 340, and LED 360.

Cap 390 comprises protrusion 392 and is sized and dimensioned to fit over applicator tip 310. Cap 390 is partially made of a material capable of flexing at least at least 5 μm, at least 1 mm, or even more. For example, cap 390 is made of a material capable of flexing such that, when cap 390 is pressed onto applicator tip 310 with a force (e.g., of between 0.5 N and 10 N, inclusive), cap 390 flexes under tension as protrusion 392 presses against housing surface 336. Once cap 390 is pressed far enough along applicator tip 310 that protrusion 392 meets notch 334, the closed position, cap 390's tension is released as protrusion 392 recedes into notch 334. The cap can be removed from the closed position by applying a force across cap 390 to remove protrusion 392 from notch 334, placing cap 390 under tension.

When cap 390 is in the closed position, an interior wall of cap 390 presses closely against housing surface 336 such that power switch 370 is in a depressed position, and the electrical coupling between controller 340, power source 350, and LED 360 is broken. When the cap is uncoupled from applicator tip 310, power switch 370 returns to an extended position and the electrical coupling between controller 340, power source 350, and LED 360 is complete. It should be appreciated that other coupling mechanisms can be used to couple cap 390 to applicator tip 310, including for example adhesives, magnets, mated groves, Velcro, latches, and friction.

Although the caps and applicator tips described herein releasably couple to one another via protrusions and notches, it should be appreciated that contemplated caps and applicator tips can couple to one another via any commercially suitable mechanism (e.g., male threading on applicator tip, and female threading on inner surface of cap).

FIG. 3B depicts the same applicator assembly 300 as FIG. 3A, except that LED 360 is embedded in housing wall 330 closer to power source 350 and directed toward rolling applicator 320. FIG. 3C depicts the same applicator assembly 300 as FIG. 3A, except that LED 360 is embedded in housing wall 330 below controller 340 and directed toward the contents of reservoir 380. While not generally preferred in all embodiments, it is contemplated that the LED can be partially or completely disposed outside of the housing wall (e.g., not completely embedded), within the housing.

Figure 4:
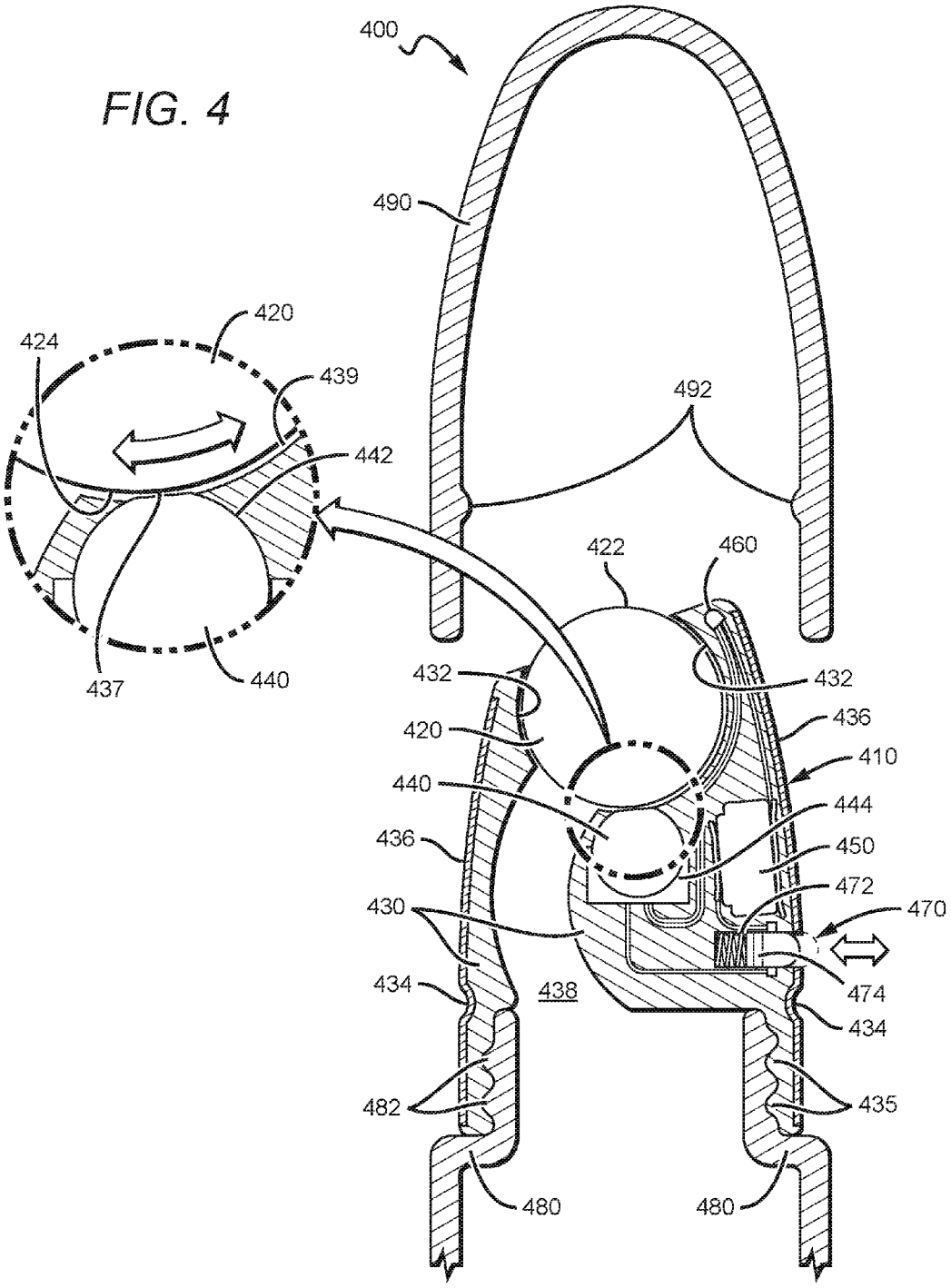
FIG. 4 is a vertical cross section view of an applicator cap and an applicator tip attached to a reservoir.

FIG. 4 depicts applicator assembly 400 with similar numbering and description as FIGS. 3A-C. In contrast to FIGS. 3A-C, applicator assembly 400 comprises controller 440. As depicted in FIG. 4, controller 440 is a flat panel coupled to housing wall 430 such that a portion of controller 440 is in communication with a surface of rolling applicator 420. It should be apparent that controller 440 could be coupled to the interior surface of housing wall 430, or embedded partially or completely within housing 430, such that communication between rolling applicator 420 and controller 440 is indirect or takes place via electromagnetic or thermal force.

Controller 440 comprises controller contact surface 442. Controller 440 is sized and positioned such that surface 442 can be in physical contact with applicator contact surface 424 at point 437. Controller 440 and rolling applicator 420 can be configured such that a rotation of applicator 420 is detected by controller 440. The detection can be accomplished by, for example, a sensor that detects a pressure is being applied to the controller via the rolling application (as it is pressed on the user for application). Additionally or alternatively, the detection could be accomplished by, for example, embedding a plurality of magnets with variable properties in rotating applicator 420 and configuring controller 440 to detect changes in magnetic properties or electromagnetic fields. As rotating applicator moves, the corresponding movement of the plurality of magnets, or the change in electromagnetic field properties, can be detected by controller 440 and used to vary an attribute of light from LED 460, preferably wavelength or intensity.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. An applicator assembly, comprising:

a housing having a first end;

a rolling applicator rotatably coupled to the first end of the housing;

a rolling controller disposed rotatably within the housing such that the rolling controller moves in response to a movement of the rolling applicator; and a light source at least partially disposed in a portion of the housing, and electrically coupled to the rolling controller such that a wavelength of a light emitted from the light source is modified when the rolling controller moves.

2. The applicator assembly of claim 1, further comprising a flowable substance disposed within the housing.

3. An applicator assembly, comprising:

a housing portion having a wall, a passage, a first end, and a second end;

a rotating applicator positioned at the first end;

a controller coupled to the wall, wherein at least a portion of a surface of the controller contacts at least a portion of a surface of the rotating applicator;

a light source coupled to the controller and a power source, and wherein the controller comprises a rounded object rotatably coupled to the wall.

4. The applicator assembly of claim 3, wherein the light source is a LED.

5. The applicator assembly of claim 3, wherein the controller changes an attribute of light emitted by the light source.

6. The applicator assembly of claim 5, wherein the controller changes the attribute based on a rotation of the rotating applicator.

7. The applicator assembly of claim 3, wherein the power source is in electrical communication with the controller.

8. The applicator assembly of claim 3, wherein each of the housing, the rotating applicator, and the controller are at least partially plastic.

9. The applicator assembly of claim 3, further comprising a cap removably coupled to at least a portion of an outer surface of the housing first end.

10. The applicator assembly of claim 9, wherein removing the cap closes a circuit between a power source and the controller.

11. The applicator assembly of claim 3, further comprising a second light source.

12. The applicator assembly of claim 11, wherein the second light source is a second LED.

13. An applicator assembly, comprising:

a housing portion having a wall, a passage, a first end, and a second end;

a rotating applicator positioned at the first end;

a controller coupled to the wall, wherein at least a portion of a surface of the controller contacts at least a portion of a surface of the rotating controller;

a first light source coupled to the controller and a power source, wherein the power source is in electrical communication with the controller;

a power switch in electrical communication with the power source and the controller, wherein at least a portion of the power switch extends past an outside surface of the housing;

wherein the first light source is a LED;

wherein the first end comprises a socket, and wherein the rotating applicator is rotatably locked within the socket;

wherein the controller is at least partially embedded within the wall of the housing; and wherein a rotation of the controller changes an attribute of light emitted by the LED.

14. The applicator assembly of claim 13, wherein the LED is embedded in the wall and positioned in the socket.

15. The applicator assembly of claim 13, wherein the LED is embedded in the wall and positioned below the controller.

16. The applicator assembly of claim 13, wherein the LED extends towards the first end.

17. The applicator assembly of claim 13, wherein the LED extends towards the second end.

* * * * *